US009908756B2

(12) United States Patent
Heravi et al.

(10) Patent No.: US 9,908,756 B2
(45) Date of Patent: Mar. 6, 2018

(54) CONSTANT PULL WINCH CONTROLS

(71) Applicants: Warn Industries, Inc., Clackamas, OR (US); Parker-Hannifin Corporation, Cleveland, OH (US)

(72) Inventors: Oliver Heravi, Tigard, OR (US); Randy C. Karambelas, Milwaukee, OR (US); Roger Paul Gray, II, Greeneville, TN (US); Alexander Milanese, Merano (IT); Ronald P. Middendorf, Norwood, MN (US); Anthony J. Wroblewski, Antioch, IL (US); Kirk A. Lola, Rutherfordton, NC (US); Mark D. Schuster, Garfield, MN (US); Thomas J. Larson, Portland, OR (US)

(73) Assignees: Parker-Hannifin Corporation, Cleveland, OH (US); Warn Industries, Inc., Clackamas, OR (US)

( * ) Notice: Subject to any disclaimer, the term of this patent is extended or adjusted under 35 U.S.C. 154(b) by 303 days.

(21) Appl. No.: 14/039,079

(22) Filed: Sep. 27, 2013

(65) Prior Publication Data

US 2014/0091268 A1 Apr. 3, 2014

Related U.S. Application Data

(60) Provisional application No. 61/707,335, filed on Sep. 28, 2012, provisional application No. 61/777,637, filed on Mar. 21, 2013.

(51) Int. Cl.
*B66D 1/50* (2006.01)
*B66D 1/46* (2006.01)

(52) U.S. Cl.
CPC ..... *B66D 1/50* (2013.01); *B66D 1/46* (2013.01); *B66D 1/505* (2013.01)

(58) Field of Classification Search
CPC ..... B65H 2511/14; B66D 5/26; B66D 5/30; B66D 1/46; B66D 1/50; B66D 1/505; Y10S 254/90
See application file for complete search history.

(56) References Cited

U.S. PATENT DOCUMENTS 2,683,020 A * 7/1954 Nickle ..... E21B 19/02 137/540
2,916,227 A * 12/1959 Bowen, Jr. ..... B65H 23/005 242/413.2

(Continued)

FOREIGN PATENT DOCUMENTS

CN 101229907 A 7/2008
CN 101261170 A 9/2008

(Continued)

*Primary Examiner* — Michael E Gallion
(74) *Attorney, Agent, or Firm* — McCoy Russell LLP

(57) ABSTRACT

A constant pulling force winch control system includes a sensor that senses a degree of winding of a winch cable around a winch drum, and a control system configured to control a winch motor to achieve a constant pulling force on the winch cable based on the degree of winding sensed by the sensor. The sensor may be a position sensor that measures a position of the winch cable relative to a centerline of the winch drum as the degree of winding. The position sensor may sense an angular position of a tension plate relative to a tensioner shaft to measure the degree of winding. The winch motor may be a hydraulic winch motor or an electric motor, and the control system is configured to control the power applied to the hydraulic winch motor to achieve the constant pulling force based on the degree of winding sensed by the sensor.

10 Claims, 13 Drawing Sheets

(56) References Cited

U.S. PATENT DOCUMENTS 2,974,216 A * 3/1961 Inoue ..... B23H 7/02 219/69.12
3,208,729 A * 9/1965 Townsen ..... B66D 3/24 200/61.15
3,293,899 A * 12/1966 Terras ..... B21C 1/00 72/256
3,330,154 A * 7/1967 Habern ..... B66D 1/50 73/862.393
3,677,520 A * 7/1972 Koomey ..... E21B 19/02 254/271
3,801,071 A * 4/1974 Barron ..... B63B 21/56 114/254
3,871,714 A * 3/1975 Behrend ..... B66D 5/26 254/361
3,938,595 A * 2/1976 Swenson ..... E21B 1/02 173/1
3,959,608 A * 5/1976 Finlayson ..... B66F 9/205 187/228
3,982,710 A 9/1976 Teumer
4,005,852 A * 2/1977 Schmitmeyer ..... B66D 1/54 212/278
4,022,391 A * 5/1977 Stein ..... B65H 54/2872 242/447.2
4,132,387 A * 1/1979 Somerville ..... B66D 1/52 254/340
4,175,727 A * 11/1979 Clarke ..... B66D 5/26 192/12 R
4,177,731 A * 12/1979 Kleist ..... B41J 33/44 101/336
4,278,365 A * 7/1981 Sandberg ..... E02F 3/8808 37/309
4,284,253 A * 8/1981 Uribe ..... B66D 5/26 188/155
4,424,939 A * 1/1984 Ohashi ..... H01F 41/08 242/434.8
4,448,394 A * 5/1984 LeMoine ..... E21B 19/008 254/271
4,475,163 A * 10/1984 Chandler ..... B66D 1/505 377/17
4,537,364 A 8/1985 Pollman et al.
4,624,450 A * 11/1986 Christison ..... B66D 1/52 254/272
4,708,301 A 11/1987 Kataoka
4,854,547 A * 8/1989 Oliphant ..... B66D 1/08 254/271
4,898,336 A * 2/1990 Reist ..... B65H 5/28 242/528
4,928,925 A * 5/1990 Christison ..... B63B 23/50 254/264
RE33,240 E * 6/1990 Lothamer ..... B65H 54/325 242/118.4
4,953,829 A * 9/1990 Knaack ..... B66D 1/34 242/586.2
5,007,599 A * 4/1991 Forsyth ..... B65H 75/4489 191/12.2 A
5,161,749 A * 11/1992 Badiali ..... B65H 57/22 242/128
5,209,414 A * 5/1993 Clemens ..... B65H 54/10 242/478.2
5,295,664 A * 3/1994 Kamper ..... B60P 7/083 254/220
5,310,125 A * 5/1994 Kitamura ..... H01F 41/0612 242/447.2
5,551,644 A * 9/1996 Linderoth ..... B65H 54/286 242/478.2
5,806,781 A * 9/1998 Ujita ..... H01F 41/122 242/444.5
5,992,203 A * 11/1999 Chubb ..... B21D 5/042 242/419.4
6,012,707 A * 1/2000 Enlund ..... B66D 1/44 254/323
6,030,496 A * 2/2000 Baggot ..... B65H 16/10 162/111
6,079,576 A * 6/2000 Bosler ..... B66D 1/44 212/278
6,085,957 A * 7/2000 Zinniel ..... B65H 51/30 226/43
6,135,421 A * 10/2000 Bartelme ..... B66D 3/24 254/268
6,286,629 B1 * 9/2001 Saunders ..... B66B 9/0853 187/394
6,347,462 B1 * 2/2002 Steinich ..... G01B 3/11 33/755
6,354,158 B1 * 3/2002 Eidem ..... B66D 1/46 73/152.59
6,372,065 B1 * 4/2002 Tabuchi ..... G03B 17/305 156/191
6,523,806 B2 * 2/2003 Bartal ..... B66D 1/365 254/272
6,629,663 B1 * 10/2003 Bettendorf ..... B65H 18/00 242/534
6,659,386 B1 * 12/2003 Rienas ..... B65H 63/0321 242/478.2
6,811,112 B1 * 11/2004 Currie ..... B65H 54/2872 242/157.1
7,063,306 B2 * 6/2006 Sanders ..... B66D 1/485 254/361
7,090,200 B2 * 8/2006 Morse ..... B66D 3/18 254/272
7,104,214 B2 * 9/2006 Niebur ..... B63B 21/50 114/230.2
7,410,116 B2 * 8/2008 Planck ..... B65H 54/283 242/481
7,543,798 B2 * 6/2009 Cunningham ..... B66D 3/20 191/12.2 R
7,568,650 B2 * 8/2009 Barker ..... A01K 89/0114 242/157.1
7,789,374 B2 * 9/2010 Averill ..... B66D 1/22 254/323
7,866,630 B2 * 1/2011 Ueki ..... A01K 73/06 242/413.5
7,883,450 B2 * 2/2011 Hidler ..... A61H 3/008 212/104
7,967,234 B2 * 6/2011 Baugh ..... E21B 19/22 166/355
8,141,260 B2 * 3/2012 Pellen ..... G01B 11/26 33/366.24
8,403,302 B2 * 3/2013 Erel ..... B66C 23/02 248/205.1
8,613,426 B1 * 12/2013 Holland ..... H02G 1/06 242/615
8,909,379 B2 * 12/2014 Fisher ..... B66C 21/00 472/80
9,243,965 B2 * 1/2016 Williams ..... G01L 5/103
2001/0054667 A1 * 12/2001 Komatsu ..... B65H 75/08 242/596.1
2002/0117654 A1 * 8/2002 Bartal ..... B66D 1/365 254/323
2007/0089925 A1 * 4/2007 Addleman ..... B66C 23/66 180/313
2008/0061276 A1 * 3/2008 Averill ..... B66D 1/46 254/323
2010/0051767 A1 * 3/2010 Erel ..... B66C 23/02 248/205.1
2011/0044599 A1 * 2/2011 Kowalczyk ..... G02B 6/4453 385/135
2011/0049286 A1 * 3/2011 Harada ..... B65H 59/04 242/421.2
2012/0168397 A1 * 7/2012 Lim ..... B66D 3/18 212/273
2013/0195596 A1 * 8/2013 Brenny ..... E02F 3/36 414/722
2014/0027429 A1 * 1/2014 Chantry ..... B23K 9/124 219/137.7
2014/0109682 A1 * 4/2014 Mupdende ..... G01N 3/08 73/812

(56) References Cited

U.S. PATENT DOCUMENTS

| | | | | |
|---|---|---|---|---|
| 2014/0264209 | A1* | 9/2014 | Lin | G01B 11/26 254/266 |
| 2014/0306829 | A1* | 10/2014 | Pereira | B66B 5/12 340/668 |
| 2015/0034757 | A1* | 2/2015 | Bixler | G01B 11/0608 242/534 |

FOREIGN PATENT DOCUMENTS

| | | | | |
|---|---|---|---|---|
| CN | 201296616 | Y | | 8/2009 |
| JP | 11079680 | A | * | 3/1999 |
| JP | 2009126613 | A | * | 6/2009 |

* cited by examiner

CONSTANT PULL WINCH CONTROLS

CROSS-REFERENCE TO RELATED APPLICATIONS

This application claims the benefit of U.S. Provisional Application No. 61/707,335, filed on Sep. 28, 2012 and U.S. Provisional Application No. 61/777,637, filed on Mar. 21, 2013. The entire disclosures of each of the above applications are incorporated herein by reference.

FIELD OF THE INVENTION

The present disclosure is directed to rotary line devices, such as winches and the like, and particularly to a rotary line device/winch integrated into an electro hydraulic hybrid vehicle having a power and control system to achieve a constant pull force. The present disclosure further relates to winches and more particularly to a drum layer compensated load limiting controller for a winch.

BACKGROUND OF THE INVENTION

A conventional rotary line device, also referred to as a winch, includes a support structure that is attachable to a recovery vehicle. A winch drum is rotatably mounted on the support structure, with a winch cable or rope being attached to the winch drum and wound about the winch drum in multiple layers. A reversible winch motor is mounted on the support structure for rotating the drum, with a speed reduction transmission connected between the winch motor and the drum. A normally-engaged, releasable drum brake assembly also is mounted on the support structure and connected to the winch drum to stop drum rotation.

A control system is operable to release the drum brake and operate the winch motor in the appropriate direction to pay out or pull in the winch cable as needed. Typically, the winch motor is a single or dual displacement reversible hydraulic motor, and the control system likewise is hydraulic because hydraulic systems can provide high power but are relatively uncomplicated and easy to maintain and service. Electric winch motors and control systems alternatively may be employed.

FIGS. 1A and 1B are simplified schematics that illustrate the general forces applicable to winch operation. FIGS. 1A and 1B each depicts a winch 10 including a drum 12 positioned on a support structure 14. A rope is wound around the drum 12, which would be connected at the unwound end to a load to be pulled. In FIGS. 1A and 1B, the distances r and r' represent an effective radius from the center of the drum to the outer edge of the wound rope that currently is wrapped around the drum. In practice, the unwound portion of the rope would then be connected at the rope end to a load. Referring to FIG. 1A in particular, for a load F representing a load to be moved by the winch, the torque T experienced by the winch from the resistance force of the load is equal to the load multiplied by the distance r constituting the distance from the center of the drum to the outer edge of the wound rope, such that $T=F*r$. Referring to FIG. 1B, as the rope is wound resulting in longer radial distance r' to the outer edge of the wound rope, the effective lever arm of the winch system increases, which increase the torque on the winch drum to an amount T'. Because the load F remains the same, $F=T/r=T'/r'$. The maximum torque experienced by the drum, therefore, occurs when the rope essentially is fully wound around the drum.

In conventional rotary line devices, such as the described winch, the components, and particularly the support structure and winch rope, are designed and constructed to exert and withstand desired maximum pulling tension and torque forces, essentially the forces experienced when the rope is fully wound. Such maximums typically are substantially greater than the pulling force actually required to pull a load when the rope is unwound within a typical range of usefulness. Relatedly, in a single displacement hydraulic motor, the maximum hydraulic fluid flow and pressure differential across the motor are likewise constant and set based on such maximum requirements, resulting in the maximum motor torque and motor speed also being constant based on the desired maximum capabilities of the winch.

In operation of a winch and associated winch motor, therefore, as the number of layers of winch cable or rope wound about the axis of the drum increases from being wound, the load "seen" by the winch motor increases. This is because the mechanical advantage against the winch increases by virtue of the increase in length of the effective lever arm by adding layers of wound rope. The result can be that the winch can no longer pull the load because with each successive layer of rope that forms on the drum, the pulling force proportionally decreases. For conventional hydraulic winch motors, for which the motor typically has a constant pressure applied, it is not unusual for a winch to lose 40% of the pulling force by as little as the fifth layer of wound rope. Thus, increased torque from the motor above that when wrapping the first layer of cable is required to counteract the proportional decrease in the pulling force as each successive layer of cable wraps around the drum. As a result, the winch components must be designed to withstand the greatest pulling force imposed by the motor when only a single layer of cable is present, even though this greatest pulling force is substantially greater than the force actually produced on successive layers of cable.

Accordingly, a conventional winch is designed so as to accommodate a rope size and structural integrity sufficient for the maximum line pull produced with the first rope layer. To meet this need, conventional retrieval winches and similar rotary line devices are relatively large physically to meet the greatest pulling force requirements. It is desirable, however, to mount such retrieval winch devices onto a vehicle of relatively modest size (e.g., pickup truck, SUV, light truck or car) in which space is at a premium. It has been difficult, therefore, to balance the need for a large winch device to meet the greatest pulling force requirements with a small size for vehicle mounting, while still practically having sufficient power for typical usages.

In conventional winches, the line pull force on the cable or rope is a function of motor torque and the drum diameter that is largely influenced by the number of layers of cable or rope that are wrapped around the drum. Thus, for a given motor torque or current, the available line force is dependent on the number of layers of rope or cable that are wrapped on the drum.

The accepted practice for rating winches for rated load is the maximum pull force on the bottom layer of rope or cable that is wrapped around the drum. Conventional methods for limiting the load of hydraulic winches to prevent rope breakage indirectly limit the load using a pressure relief valve. This results in reduced rated load on subsequent layers due to increased torque on the drive motor therefore reaching the relief pressure at lower and lower loads proportional to the layer.

Historically, one alternative is to use a traction winch with a separate storage drum adding both weight and expense.

SUMMARY OF THE INVENTION

The winch of the present disclosure provides a generally constant pull force as the cable or rope is rewound onto the winch drum. According to an embodiment, the winch utilizes a hydraulic motor to rotate the winch drum to extend or retract the cable or rope. The hydraulic motor may be a low speed high torque motor, or any other appropriate hydraulic motor. When the cable or rope is rewound, the lever arm of the winch increases by virtue of the increase of the distance from the centerline of the drum to the outer limit of the wound portion of the rope. The pulling force exerted on the cable rope thus decreases as the distance increases from the outer edge of the layered wound portion of the cable or rope to the centerline of the winch drum. To maintain a constant pulling force, the hydraulic fluid pressure to the hydraulic motor must be increased proportionally with the increase in distance associated with the number of layers of cable wrapped around the drum.

The constant pulling force is maintained using a feedback control system. In one exemplary embodiment of such system, the rope position is determined using a position sensor that rests against the cable or rope that is wound onto the drum. The position sensor may be integrated into a tensioner that is common in various types of winches. As a tensioner plate of the tensioner is forced away from the drum by the cable or rope wrapping around the drum in a layered fashion, the change in position of the rope is determined using the position sensor. The control system then increases the pressure to the hydraulic motor to maintain a constant pull force. Another method to compensate for the changes due to the wrapping of the cable or rope around the drum is to sense the change in load on the cable or rope when the distance from the rope and the axis of rotation of the drum changes. The control system then increases the pressure to the hydraulic motor to maintain a constant pull force.

Accordingly, aspects of the invention include a constant pulling force winch control system, and a related winch system and methods of operating such a system under control of the described control system. Exemplary embodiments of the winch control system include a sensor that senses a degree of winding of a winch cable around a winch drum, and a control system configured to control a winch motor to achieve a constant pulling force on the winch cable based on the degree of winding sensed by the sensor. The sensor may be a position sensor that measures a position of the winch cable relative to a centerline of a winch drum as the degree of winding. The position sensor may sense an angular position of a tension plate relative to a tensioner shaft to measure the degree of winding. The winch motor may be a hydraulic winch motor, and the control system is configured to control the hydraulic pressure applied to the hydraulic winch motor to achieve the constant pulling force based on the degree of winding sensed by the sensor. Alternatively, the winch motor may be an electric motor and the control system is configured to control the electric current applied to the electric winch motor.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

DETAILED DESCRIPTION

Figures 1A, 1B:
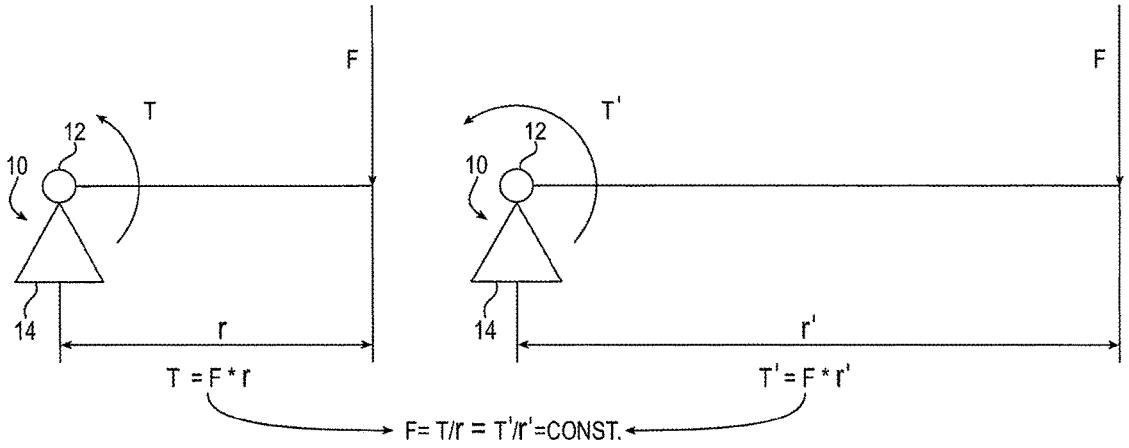
FIGS. 1A and 1B are schematic diagrams that illustrate the general forces applicable to operation of an exemplary winch.

Embodiments of the present invention will now be described with reference to the drawings, wherein like reference numerals are used to refer to like elements throughout. It will be understood that the figures are not necessarily to scale.

Figure 2A:
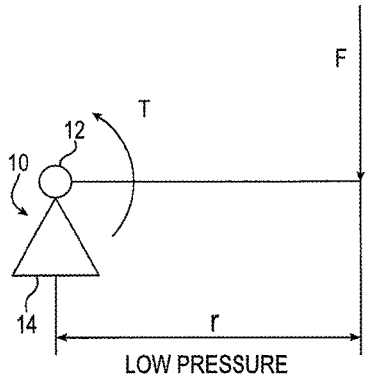
FIGS. 2A and 2B are schematic diagrams illustrating general pressure control of a constant force hydraulic motor winch.
Figure 2B:
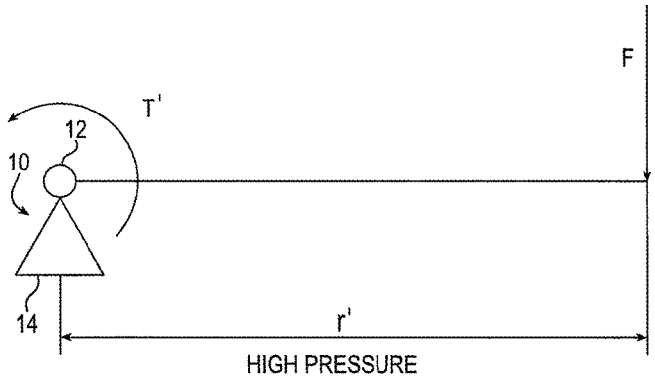

FIGS. 2A and 2B are schematic diagrams modified from FIGS. 1A and 1B, which illustrate general pressure control of a constant force hydraulic motor winch. Such pressure control follows from the consequence of the winch forces depicted in FIGS. 1A and 1B. The hydraulic pressure is controlled so as to maintain a constant predetermined pulling force on the rope. As seen in FIG. 2A, when the distance "r" to the outside edge of the cable wound around the drum is relatively small due to the cable or rope being largely unwound, the load seen by the hydraulic motor is relatively small due to the decreased effective lever arm. To maintain the predetermined force on the rope, a relatively low pressure applicable to the hydraulic motor is required. As seen in FIG. 2B, as the cable or rope is wound around the drum, the distance "r" to the outside edge of the cable wound around the drum increases to "r'", and the load seen by the hydraulic motor proportionally increases as well. If the hydraulic pressure were to be maintained as constant (as done in conventional winch devices), the pulling force on the rope would decrease proportionally. Accordingly, to avoid the decrease in pulling force and instead maintain the predetermined constant pulling force on the rope, the hydraulic pressure must be increased as seen in FIG. 2B. The result is that the hydraulic pressure applicable to the motor at r' in FIG. 2B is a high pressure relative to the hydraulic pressure applicable to the motor at the shorter distance r in FIG. 2A.

Figure 3:
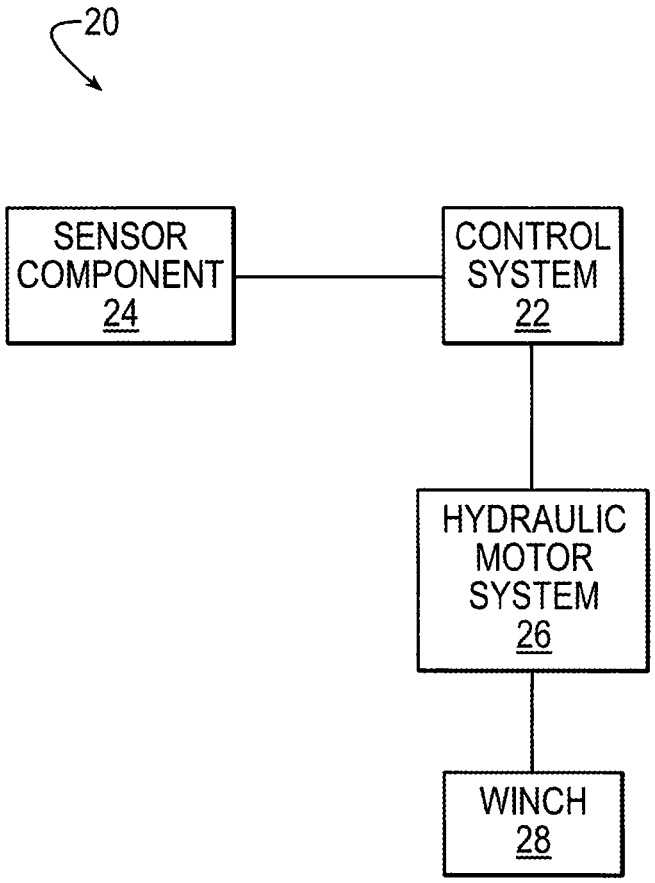
FIG. 3 is a block diagram depicting operative portions of an exemplary winch system that maintains a constant pulling force on a winch cable or rope.

FIG. 3 is a block diagram depicting operative portions of an exemplary winch system 20 that maintains a constant maximum pulling force on a winch cable or rope. The system includes a control system 22, a sensor component 24, a hydraulic motor system 26, and a winch 28. Although FIG. 3 depicts the system components as separate components, the components may be combined in various fashions as would be understood by those of ordinary skill in the art.

The control system 22 may be configured as one or more processor devices, microprocessors, control circuits or like device as are known in the art as utilized in electronic control systems. The controller further may include memory devices and/or comparable computer readable media for storing executable computer program code that when executed, causes the control of hydraulic pressure so as to maintain a constant maximum pulling force of a winch rope. To achieve such control, the winch system 20 may include at least one sensor component 24 that senses the degree of winding of the winch cable or rope. As described above, such degree of winding is indicative of the load seen by the winch and thus provides an effective basis for control of hydraulic pressure to maintain a constant pulling force. Collectively, the control system 22 and sensor component 24 may be referred to as a constant pulling force winch control system 22/24.

As further described below, in exemplary embodiments the sensor component 24 is a position sensor that senses a position of the cable or rope relative to a centerline of the winch drum. The sensed position of the cable or rope effectively constitutes a measure of the radial distance r or r' as described above with respect to FIGS. 1 and 2. In an alternative embodiment, the sensor component 24 may be a strain gauge or like sensing device that senses the load on the winch cable directly.

Whether position or load is sensed, sensing data from the sensor component 24 is read by the control system 22 so as to dynamically provide an indication of the changing pulling force occurring as the cable or rope is wound or unwound about the winch drum. To maintain a predetermined constant maximum pulling force, the control system 22 determines a hydraulic pressure required to be applied to the motor to maintain such constant pulling force. Based on such determination, the control system 22 outputs a control signal to the hydraulic motor system 26 to adjust the hydraulic pressure applied to the motor as need to maintain a constant pulling force. For example, as the winch cable or rope is wound around the winch drum from the first layer, the sensor component senses increased windings around the drum centerline (an increasing r), and the control system 22 outputs a control signal to the hydraulic motor system to increase the hydraulic pressure. Conversely, as the winch cable or rope is unwound from the winch drum, the sensor component senses decreased windings around the drum centerline (a decreasing r), and the control system 22 outputs a control signal to the hydraulic motor system to decrease the hydraulic pressure. The hydraulic motor system in turn drives the winch 28 in a manner that maintains a constant pulling force on the cable or rope based on the dynamically changing hydraulic pressure.

Figure 4:
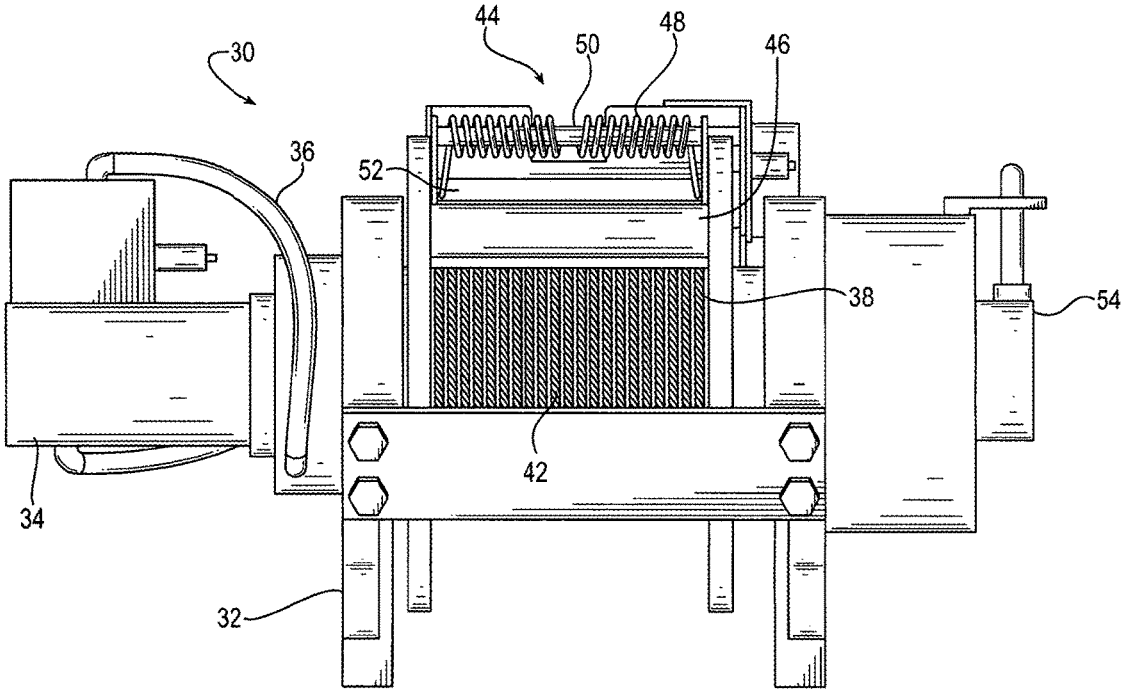
FIG. 4 is a schematic diagram depicting an exemplary winch system in accordance with embodiments of the present invention.
Figure 5:
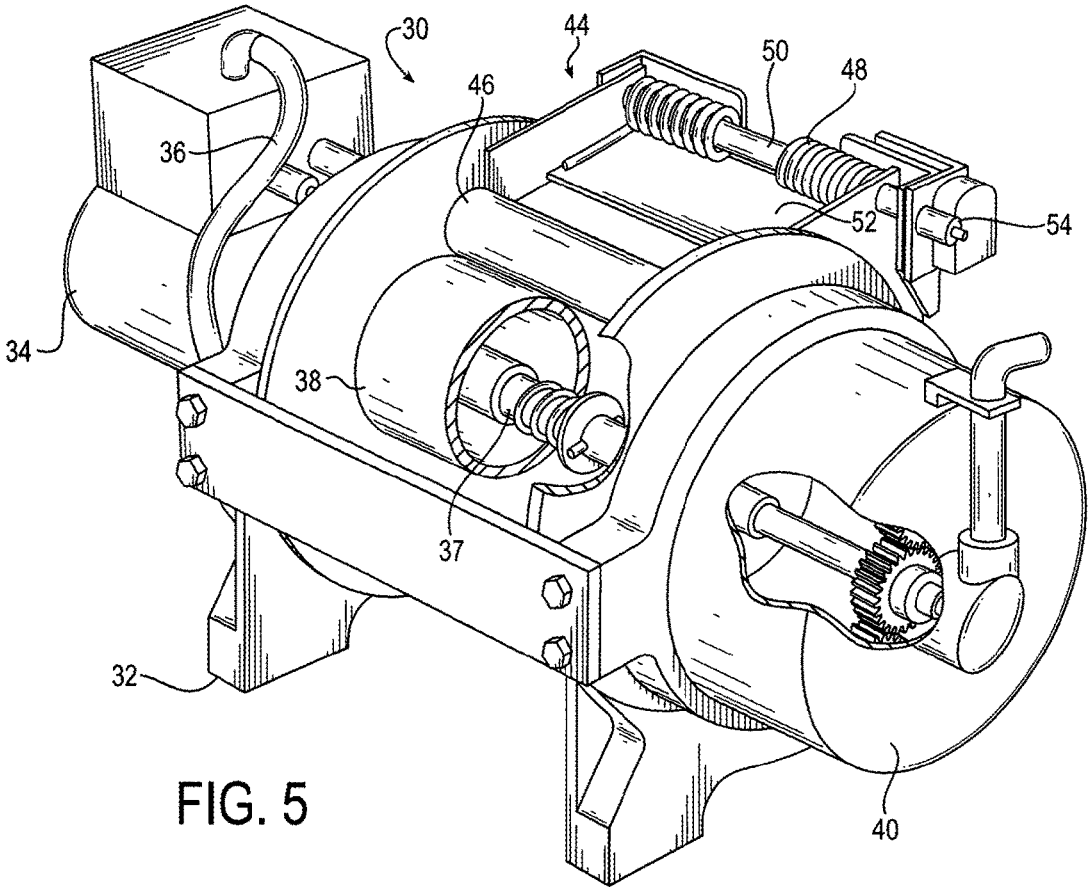
FIG. 5 is a schematic diagram depicting the exemplary winch system of FIG. 4, in which a portion of the internal components of the winch system are depicted by depicting the outer surface of the winch components in a translucent fashion.

FIGS. 4 and 5 are schematic diagrams depicting an exemplary winch system 30. In FIG. 5, a portion of the internal components of the winch system are depicted by depicting the outer surface of the winch components in a translucent fashion. The winch components are assembled about a support structure 32. The winch system further includes a motor system 34, which in exemplary embodiments is a hydraulic motor system that includes hydraulic couplings 36 for connection to a hydraulic fluid source (not shown). Although a hydraulic motor system is preferred for many winch applications, alternative motor systems, such as an electric motor system, may be employed. A braking system also may be incorporated into the hydraulic motor system 34 and/or the drum.

As seen particularly in FIG. 5, the winch system 30 includes a drum shaft 37 that runs along a center axis of a winch drum 38. A gear system 40 is in connection with the hydraulic motor system and the drum shaft 37. The hydraulic motor system 34 drives the drum shaft 37 to turn the gear system 40, which in turn causes the winch drum 38 to rotate in either a forward or reverse direction. A winch cable or rope 42 (see particularly FIG. 4) is wound around the winch drum 38, and as the winch drum rotates, the winch cable or rope is unwound from or re-wound about the winch drum, depending upon whether the winch drum is caused to rotate in the forward or reverse direction.

The control system 22, referenced above with respect to FIG. 3, may be incorporated as part of the hydraulic motor system 34. The control system controls the hydraulic pressure applied to the hydraulic motor system 34, which in turn controls the pulling forces being exerted by the winch. The hydraulic pressure can be controlled by use of regulating valves, by changing a pump speed or by other known pressure controlling systems. The control system also may engage and disengage the winch braking system as conditions warrant.

As depicted in the exemplary embodiments of FIGS. 4 and 5, the winch system 30 further may include a tensioner system 44. The tensioner system aids in maintaining tension on the cable or rope to prevent any kind of slippage, backlash, or the like so as to maintain a uniform and smooth spooling of the cable or rope. The tensioner system 44 may include a guide rod 46 that guides the cable or rope around the winch drum under tension provided by a spring 48. The spring 48 is coiled and rotatable around a tensioner shaft 50. The tensioner system 44 further may include moveable tension plate 52 that rests against the wound portion of the cable or rope adjacent the tensioner shaft 50. The tensioner plate is biased into position by the spring 48 so as to maintain a position by which the tensioner plate is pressed against the wound portion of the cable or rope. As the cable or rope is wound and unwound, this causes the tension plate to move or displace angularly relative to the tensioner shaft 50 in essentially an outward or inward radial direction relative to the drum axis. Specifically, as the cable or rope is wound around the drum, the increasing thickness of the wound rope about the winch drum causes the tension plate to move angularly upward (i.e., clockwise in the figures) relative to the tensioner shaft, and away from the drum axis and against the biasing of the spring. Conversely, as the cable or rope is unwound from the drum, the decreasing thickness of the wound rope about the winch drum causes the tension plate to move angularly downward (i.e., counterclockwise in the figures) relative to the tensioner shaft, and towards the drum axis as forced by the spring bias.

Because of the movement of the tension plate 52 with the unwinding and winding of the cable or rope, the angular position of the tension plate 52 provides an indication of the degree of winding of the drum. Furthermore, as referenced above, to maintain a constant pulling force by the winch, the hydraulic pressure applied to the hydraulic motor must be increased as the cable or rope is further wound around the drum, and conversely decreased as the cable or rope is unwound. In the present invention, because the angular position of the tension plate 52 provides a measure of the degree of winding of the cable or rope, the position of the tension plate is utilized by the control system to control the level of hydraulic pressure being applied to the motor. In an alternative system, using an electric motor, the control system controls the level of current supplied to the electric motor.

Figure 6:
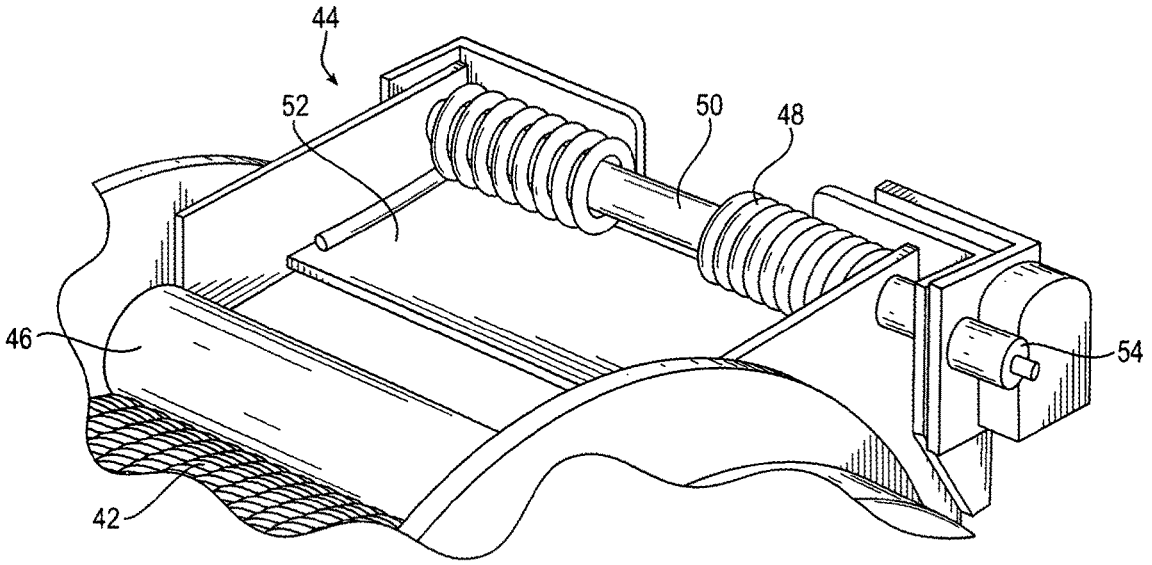
FIG. 6 is a schematic diagram depicting a closer view of a portion of the winch system of FIGS. 4 and 5.
Figure 7:
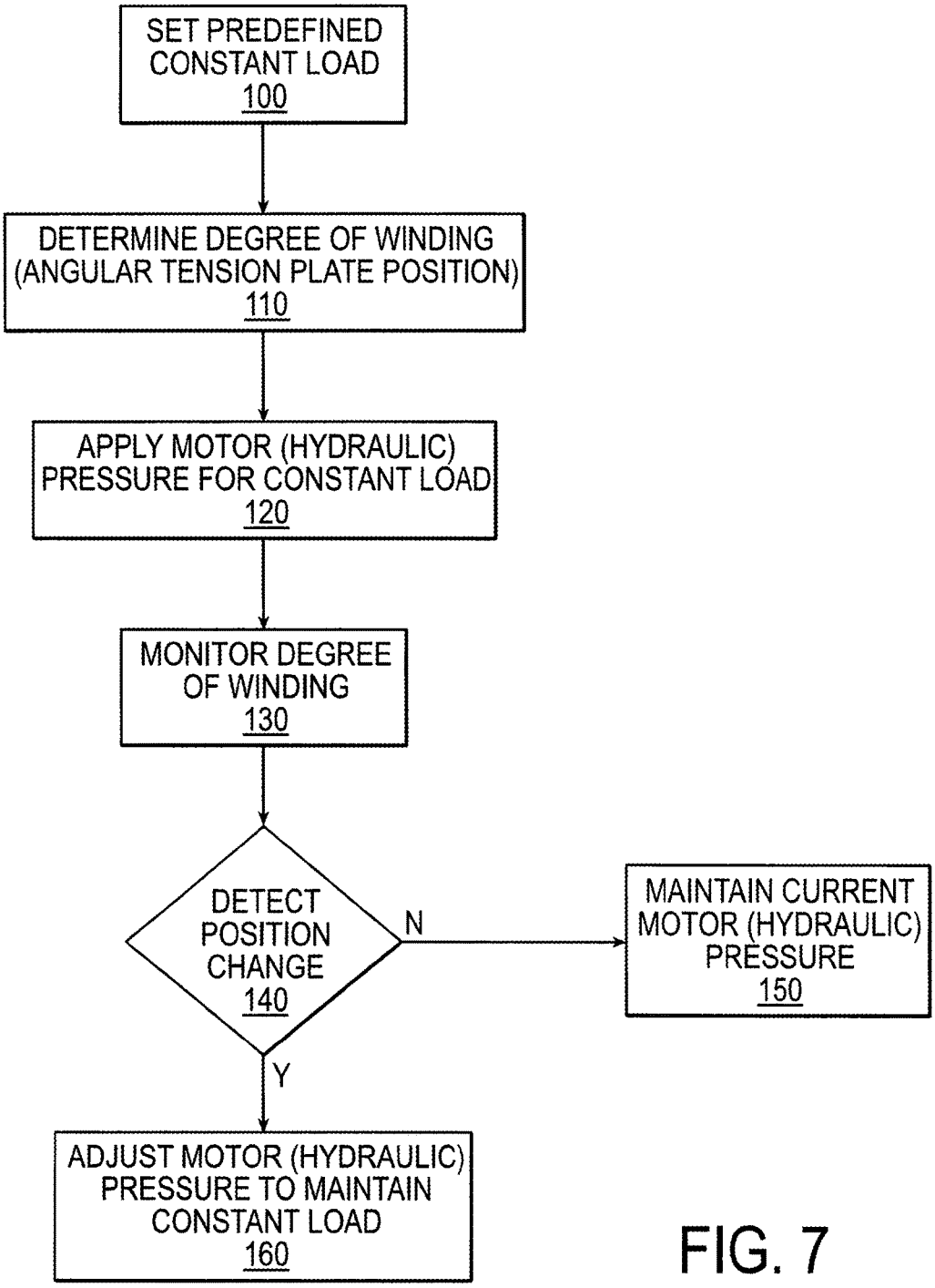
FIG. 7 is a flow chart diagram depicting an exemplary method of operating a winch system to achieve a constant pulling force.

FIG. 6 is a schematic diagram depicting a closer view of a portion of the winch system of FIGS. 4 and 5, specifically the portion of the winch system 30 including the tensioner system 44. As seen in FIGS. 4-6, and best seen in the closer view of FIG. 6, a sensor 54 is provided as part of the tensioner system 44. The sensor 54 corresponds to the sensor component depicted in the block diagram of FIG. 3. In exemplary embodiments, the sensor 54 may be a position sensor that detects a position of the tension plate 52. The position sensor 54 may more specifically be a rotary position sensor that senses the angular position of the tension plate 52 relative to the tensioner shaft 50. Position sensors of this type generally are known to those skilled in the art. Once the angular position of the tension plate is read, thereby indicating the thickness of the wound cable, the control system adjusts the hydraulic pressure applied to the hydraulic motor system so as to maintain a predefined constant pulling force. The predefined pulling force may be set based on a variety of parameters, including, for example, winch specifications and limits, cable or rope thickness and capacity, desirable load as determined for a particular application, and other suitable parameters as may be relevant to winch operation FIG. 7 is a flow chart diagram depicting an exemplary method of operating a winch system to achieve a constant pulling force. Although the exemplary method is described as a specific order of executing functional logic steps, the order of executing the steps may be changed relative to the order described. Also, two or more steps described in succession may be executed concurrently or with partial concurrence. It is understood that all such variations are within the scope of the present disclosure.

The method may begin at step 100, at which a desired predefined constant maximum pulling force is set. The predefined maximum pulling force can be set based upon the winches' maximum pulling force rating. As referenced above, the predefined maximum pulling force may set based on any suitable parameters that may be relevant to winch operation including, but not limited to, cable strength. At step 110, a degree of winding of the cable around a winch drum is determined. In exemplary embodiments, an angular position of a tension plate pressed against a wound portion of the winch cable is determined. Such angular position may be determined, for example, using the position sensor 54 described above. At step 120, a motor pressure is applied to a winch motor to achieve the predefined constant pulling force. In exemplary embodiments, the motor pressure is a hydraulic pressure applied to a hydraulic motor system such as the hydraulic motor system 34, and the hydraulic pressure may be controlled by a control system such as the control system 22.

At step 130, the degree of the cable winding is monitored, such as for example by monitoring the angular position of the tension plate. At step 140, a determination is made as to whether a change is detected in the degree of winding of the cable, such as by detecting a change in the angular position of the tension plate. Such operations may be performed by the control system 22 operating in conjunction with the position sensor 54. If a "No" determination is made in step 140, i.e., the degree of winding of the cable based on the position of the tension plate has not changed, then the method proceeds to step 150 and the current motor pressure is maintained.

If, however, a "Yes" determination is made in step 140, i.e., the degree of winding of the cable based on the position of the tension plate has indeed changed, then the method proceeds to step 160 and the motor pressure is adjusted to maintain the predefined constant pulling force. For example, when the angular position of the tension plate has adjusted upward and away from the drum axis (indicating increased wound thickness of the cable), the control system causes the hydraulic pressure to be increased to the hydraulic motor system so as to maintain the predefined constant pulling force of the motor. Conversely, when the angular position of the tension plate has adjusted downward and toward the drum axis (indicating decreased wound thickness of the cable), the control system causes the hydraulic pressure to be decreased to the hydraulic motor system so as to maintain the predefined constant pulling force of the motor.

Figure 8:
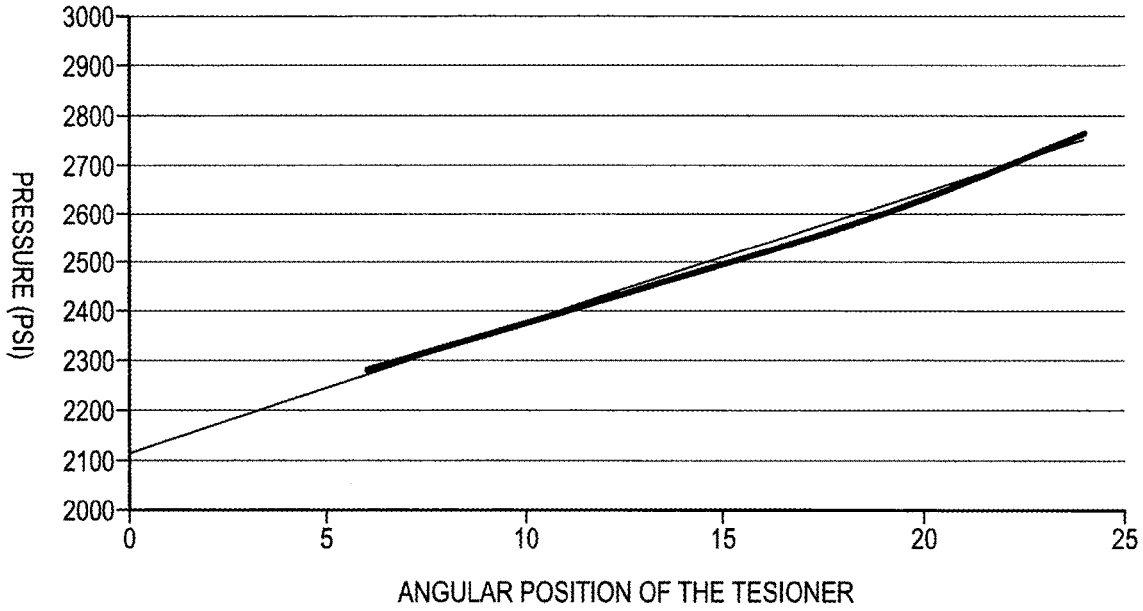
FIG. 8 is a graphical depiction of an exemplary relationship between hydraulic pressure and an angular position of a tension plate to achieve a constant winch pulling force.

FIG. 8 is a graphical depiction of an exemplary relationship between hydraulic pressure and an angular position of a tension plate to achieve a constant winch pulling force. In this example, a typical commercially available winch was utilized to achieve a predefined constant pulling force of 13,000 lb. In this example, the thicker line represents the actual data, with the thinner line represents a linear regression of the data (note that the zero degree condition represents a mathematical representation would but not physically be achievable). A linear relationship is observed as between the angular position of the tension plate and the hydraulic pressure to be applied to the motor so as to maintain the constant predefined pulling force.

Figure 9:
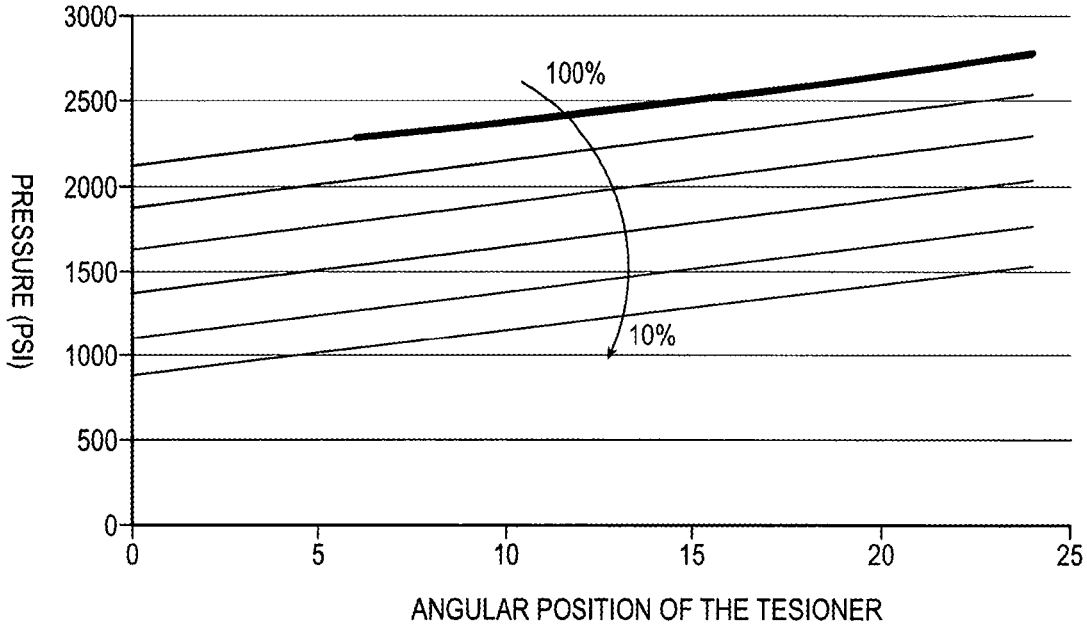
FIG. 9 is a graphical depiction of an exemplary relationship between hydraulic pressure and an angular position of a tension plate to achieve a constant winch pulling force, with the constant pulling force of FIG. 8 being adjusted by percentage.

FIG. 9 is a graphical depiction of an exemplary relationship between hydraulic pressure and an angular position of a tension plate to achieve a constant winch pulling force, with the constant pulling force of FIG. 8 being adjusted by percentage. The graph of FIG. 9 depicts a predefined constant load range from 100% down to 10% of the constant pulling force predefined in the example of FIG. 8. It can be seen from the graph of FIG. 9 that a comparable linear relationship is achieved for various different predefined constant pulling forces. As expected, the necessary applied pressure is less for decreased constant pulling force values.

It will be appreciated that the graphs of FIGS. 8 and 9 represent an example for a particular winch. Although other winches would have similar linear relationships of pressure as a function of angular position, the precise values would depend upon the winch characteristics (e.g., drum size, rope thickness and capacity, hydraulic motor specifications, etc.). Accordingly, comparable relationships of pressure as a function of angular position may be determined for given winch characteristics. As referenced above, the winch control system may be configured as one or more processor devices, microprocessors, control circuits or like devices as are known in the art as utilized in electronic control systems. The pressure/position relationships would then be configured, programmed, provided as a database or look-up table, or otherwise incorporated into the corresponding winch control system to control the winch so as to achieve a constant pulling force. For example, the winch control system may include a non-transitory computer readable medium storing a computer program, wherein when the control system executes the program the winch system performs the operational steps of the methods described above. The non-transitory computer readable medium may be, for example, an optical disk, hard drive, flash memory drive, USB memory drive, or any other suitable non-volatile or volatile computer readable medium as are known in the art.

Variations on the above embodiments may be employed. For example, in the described embodiments above a complete tensioner system, which maintains tension on the winch cable, is employed. Although such complete tensioner systems are common, they are not present in all winches and are not need for purposes of the present invention to measure position. The tension plate may be provided to measure position, even if a complete tensioner system to maintain tension on the winch cable is not otherwise provided. In this regard, in the above embodiments the tension plate is biased by the spring. In another exemplary embodiment, the tension plate passively maintains its position against the winch cable under gravity and/or with structural guides, but otherwise without the additional spring bias. In addition, multiple tension plates may be provided for positioning measurement. In one embodiment, a second tension plate is provided adjacent the rope inlet, with or without a spring bias.

Furthermore, sensors other than position sensors may be employed. As referenced above, without the described control the pulling force on the rope changes as the winch cable is wound or unwound. In exemplary embodiments, therefore, the sensor directly measures the load on the winch cable to provide the basis for control of the motor pressure. For example, the sensor may be a strain gauge that measures the load on the winch cable at the location where the cable winds about/unwinds from the winch drum.

In addition, the above embodiments were described principally with respect to utilizing a hydraulic motor to drive the winch. Comparable control however, may be applied to other types of motors, such as electrical motors and other suitable motors as are known in the art. Generally, the motor "pressure", e.g., hydraulic pressure, electrical current, etc. depending on the type of motor, is controlled based on the degree of winding of the winch cable or rope about the winch drum. For example, when the winch motor is an electrical winch motor, the control system is configured to control the electrical current applied to the electrical winch motor to achieve the constant pulling force on the winch cable based on the degree of winding sensed by the sensor. Specifically, when the degree of winding increases, the control system increases the electrical current applied to the electrical winch motor to maintain the predefined constant pulling force, and when the degree of winding decreases, the control system decreases the electrical current applied to the electrical winch motor to maintain the predefined constant pulling force.

Figure 10:
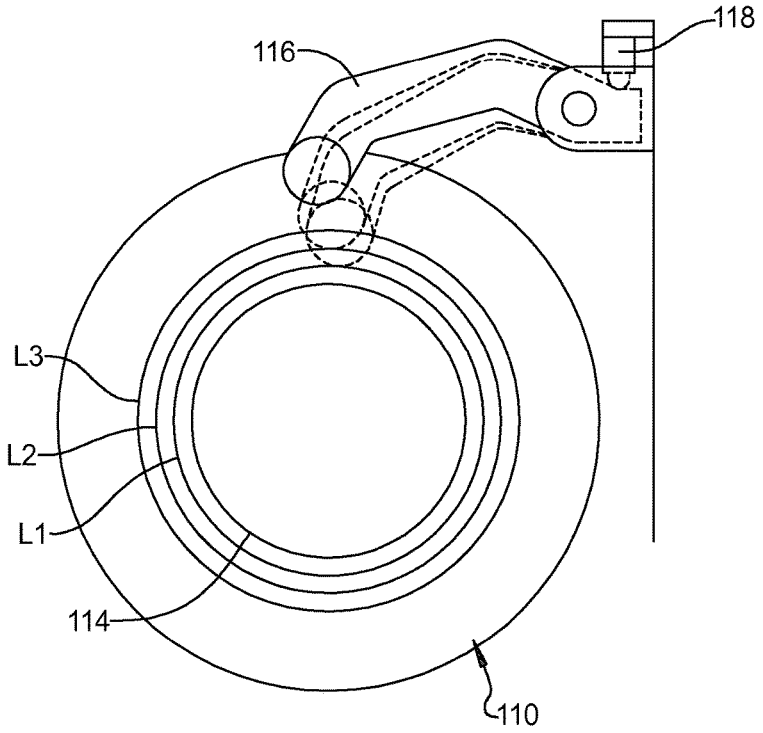
FIG. 10 is a schematic view of a hydraulic winch having a tensioner arm for detecting a number of wraps of a cable on the drum.
Figure 11:
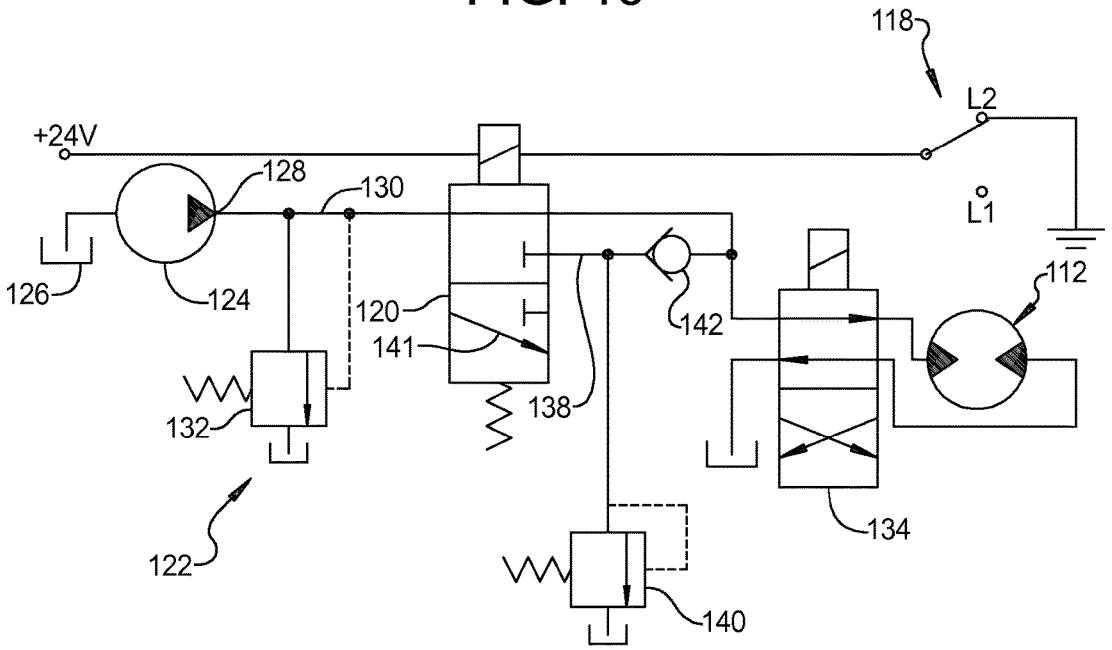
FIG. 11 is a schematic view of an electro-hydraulic circuit for controlling operation of a hydraulic winch.
Figure 12:
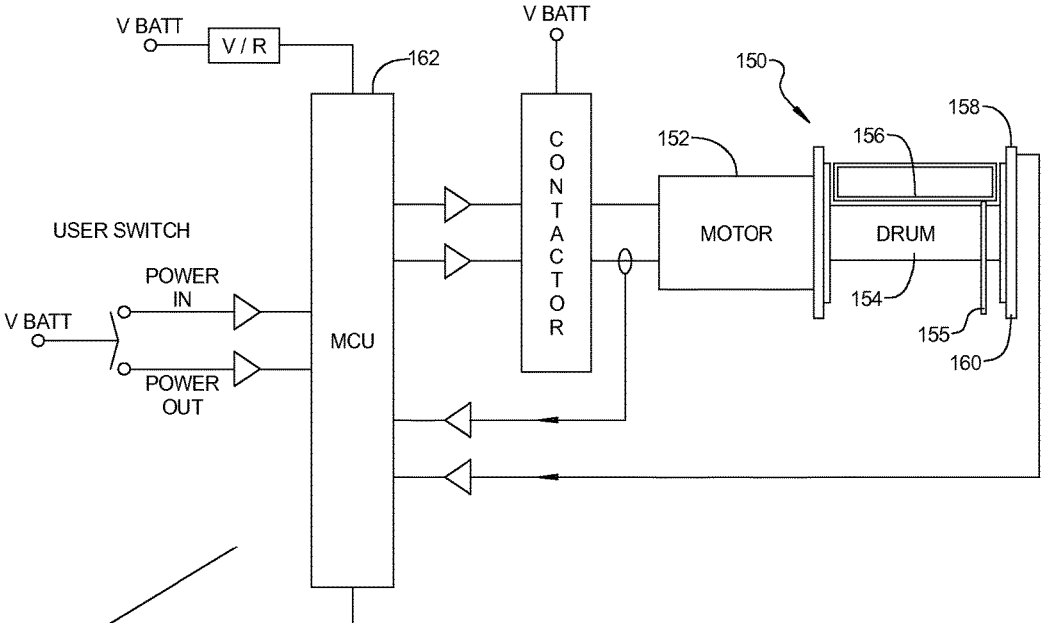
FIG. 12 is a schematic diagram of an electric winch having a tensioner arm for detecting a number of wraps of cable on the drum.

With reference to FIGS. 10 and 11, a hydraulic winch 110 is shown including layer compensated load limiting controls for a hydraulic winch 110. The winch 110 can include a hydraulic motor 112 that is drivingly connected to a drum 114 in a manner that is known in the art. A tensioner arm 116 is pivotally mounted to the winch and movably engages the top layer $L_N$ of cable that is wrapped around the drum 114. A normally open electromechanical or opto-electronic microswitch 118 is provided for sensing a pivotal position of the tensioner arm 116. The microswitch 118 is capable of sensing when the drum 114 is provided with a single layer of cable wrapped thereon for activation in a first open state and when a second or more layers of cable are provided on the drum 114, the switch 118 is switched to a closed state for providing electric current to a three-port solenoid valve 120 of an electro-hydraulic control system 122 for the winch motor 112. The electro-hydraulic control system 122 includes a pump 124 that is in communication with a sump 126. An output 128 of the pump 124 is connected to the three-port solenoid valve 120 by a passage 130. The passage 130 is provided with a system pressure relief valve 132. The three-port solenoid valve 120 is provided in communication with a winch directional control valve 134 which controls the direction of operation of the winch motor 112. The three-port solenoid valve 120 can also provide fluid communication through the passage 130 to the winch motor 112 via a bypass passage 138 that is in communication with a second reduced relief valve 140. The first system pressure relief valve 132 can provide pressure relief at a higher setting of, for example, 4000 psi, while the second system pressure relief valve 140 can provide pressure relief at a lower setting of, for example, 2600 psi.

While the winch 110 is being operated with only the bottom layer L1 of cable or rope wrapped around the drum, the tensioner arm 116 is in contact with the microswitch 118 keeping the normally open switch open (i.e., at the L1 position of switch 118 in FIG. 2). This keeps the three-port solenoid valve 120 de-energized, directing flow through the diagonally illustrated passage 141 of the valve body and through the check valve 142 to the winch motor 112. As the winch 110 approaches the rated load, the second reduced relief valve 140 opens to limit pressure to the lower setting, thus limiting the load and extending the rated load capability and limits over layer L1 of winch operation. This is also the default or failsafe mode for the system.

As the rope or cable is stored on layers L2 and higher, the tensioner arm 116 is out of contact with the switch 118 closing the switch 118 contact (i.e., at the L2 position of switch 118 in FIG. 11). This energizes the three-port solenoid valve 120 to divert fluid away from the reduced relief valve 140 which is also blocked by the check valve 142. As the winch 110 approaches the rated pulling force, the first system relief valve 132 opens to limit pressure to the higher system relief setting allowing the same rated pulling force on layers 2 and above. The present disclosure allows the capability of reducing load on the bottom layer L1 to prevent exceeding the rope strength. It is noted that multiple pressure relief valves could be used in association with each layer of rope/cable winding.

Figure 13:
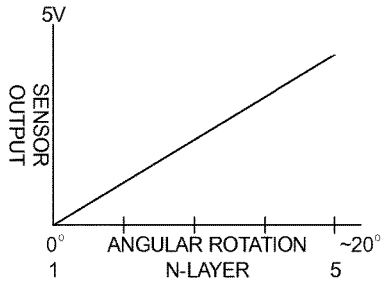
FIG. 13 is a graphical illustration of the sensor output related to the number of layers on a drum of a winch.
Figure 14:
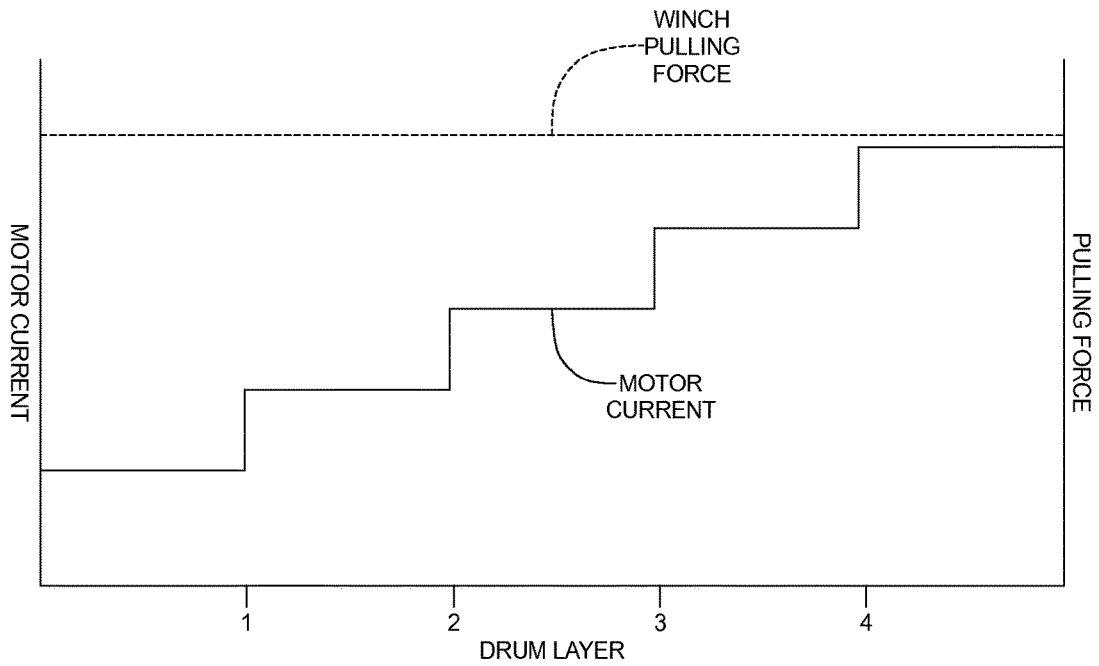
FIG. 14 is a graphical illustration of the step increased motor current limits for each drum layer in order to provide a constant pulling force.

According to an alternative embodiment, as shown in FIGS. 12-15, of the present disclosure, a load-limiter with drum layer compensator is provided for an electric winch or hoist 150. According to the present disclosure, a motor 152 is provided in connection with a drum 154 having a cable or rope 155 wrapped thereon. A tension plate 156 is provided for engaging the top layer of rope or cable 155 on the drum 154. An angular encoder 158 is coupled to the tension plate 156 and measures the effective drum radius influenced by the number of rope layers on the drum 154. As the winch/hoist 150 begins to pull in a load, the rope or cable 155 wraps around the drum 154 that changes the position of the tension plate 156. Consequently, the displacement in the tension plate 156 is measured by the angular rotary encoder 158 fixed to a drum support 160. The measured angle from the encoder output 158 is read by a real-time processor 162 to calculate the effective drum radius. FIG. 13 shows a graphical illustration of the encoder output based upon the angular position of the tension plate 156 associated with the number of layers of cable wrapped around the drum 154. This data along with the measured motor torque through motor current (measured by current sensor 164) is used by an algorithm to limit the load at a given program setpoint precisely independent of the drum layer effect. As a result, the winch can pull and limit a given constant load at all layers of rope or cable 155.

Figure 15:
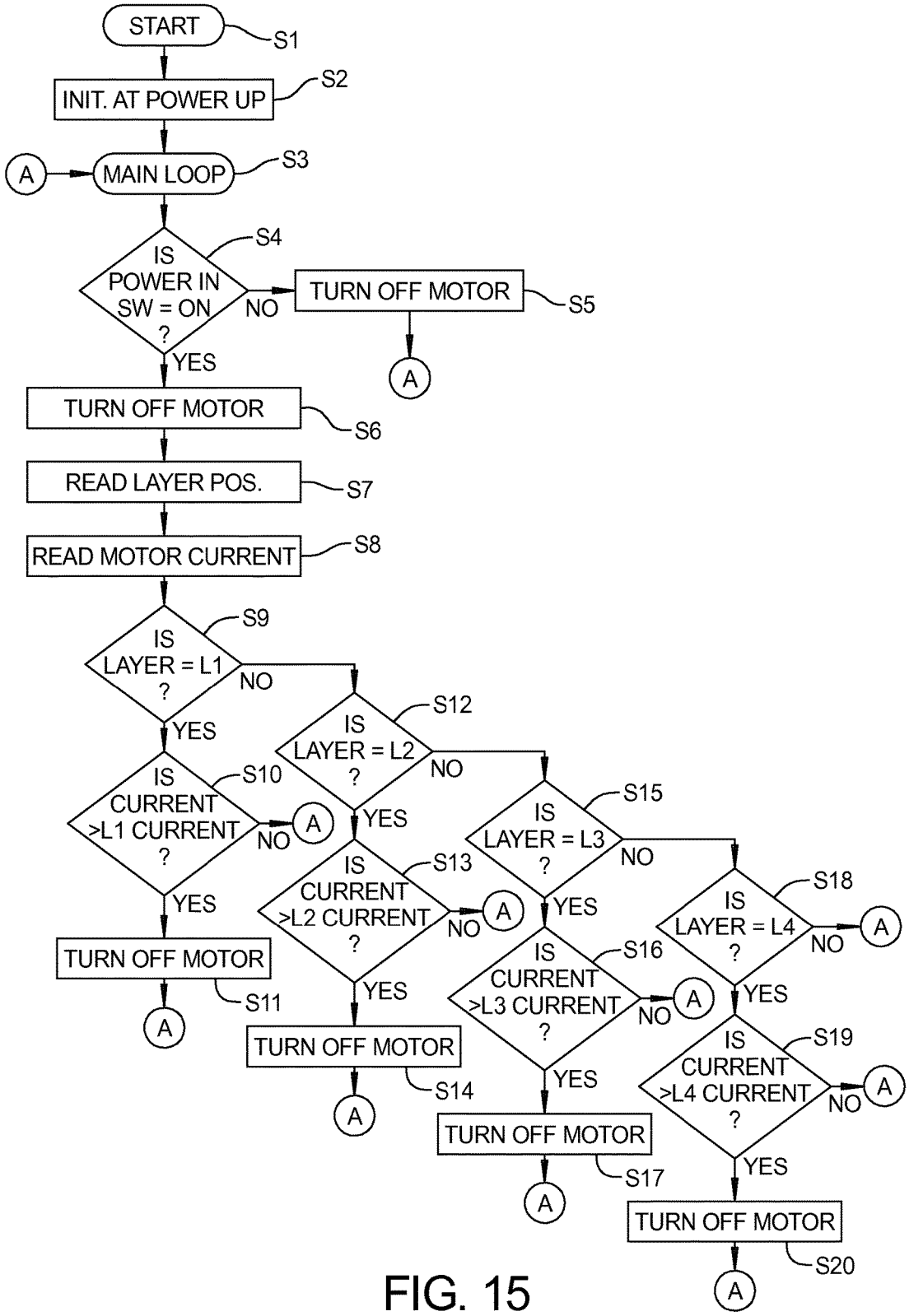
FIG. 15 is a flowchart for control of the winch according to the principles of the present disclosure.

With reference to FIG. 15, an embedded firmware flow chart is provided for controlling the winch according to the principles of the present disclosure. At step S1 the algorithm is started and the system is initiated at step S2. A main loop begins at step S3. At step S4 it is determined whether the power "IN" switch is "ON". If not, the motor is turned off at step S5 and the flow returns to return A. If the power "IN" switch is on at step S4, flow continues to step S6 where the motor is turned on. At step S7 the layer position is read as determined by the angular position sensor 158 and at step S8 the motor current through sensor 164 is determined. At step S9, it is determined whether the number of layers on the drum is one. If so, the flow continues to step S10 where it is determined whether the current to the motor is less than a predetermined layer one current L1. If it is determined that the current is greater than the layer one current L1, the flow continues to step S11 where the motor is turned off and the flow then returns to return A. If at step S9 it is determined that the number of layers is not at layer 1, the flow continues to step S12 where it is determined whether the number of layers is the second layer L2. If so, the flow continues to step S13 where it is then determined if the current to the motor is greater than a predetermined L2 current value. If yes, the motor is then turned off at step S14. If no, the flow continues back to return A. If at step S12 it is determined that the layer is not the second layer L2, flow continues to step S15 where it is determine whether the number of layers on the drum is the third layer L3. If so, flow continues to step S16 where it is determined whether the current to the motor is greater than a predetermined L3 current, and if so, the motor is turned off at step S17. If at step S15 it is determined that the number of layers of cable on the drum is not the third layer L3, then the flow continues to step S18 where it is determine whether the layer is equal to the fourth layer L4. If so, the flow continues to step S19 word is determine whether the current is greater than a predetermined L4 current. If so, flow continues to step S 20 where the motor is turned off.

Accordingly, the above described algorithm prevents the motor 152 from being operated at a current that would exceed the winches rated pulling force. In addition, the algorithm accounts for the number of layers of cable on the drum to very the current appropriately to provide a constant pulling force for the winch without exceeding the rated pulling force.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. A constant pulling force winch control system comprising: a sensor that senses a distance from a center axis of a winch drum to an outer edge of a layered wound portion of a winch cable wound around the winch drum; and a control system configured to control a winch motor, the winch motor configured to drive rotation of the winch drum, by outputting a control signal to the winch motor to adjust power applied to the winch motor, to achieve a constant pulling force on the winch cable based on the distance sensed by the sensor, wherein the winch motor is an electrical winch motor, and the control system is configured to:

control electrical current applied to the electrical winch motor to achieve the constant pulling force on the winch cable based on the distance from the center axis of the winch drum to the outer edge of the layered wound portion of the winch cable wound around the winch drum sensed by the sensor;

determine a number of layers of winch cable wound around the winch drum based on an output of the sensor;

turn off the electrical winch motor when the determined number of layers is a first layer number and the electrical current applied to the electrical winch motor is greater than a predetermined first layer number current; and turn off the electrical winch motor when the determined number of layers is a second layer number and the electrical current applied to the electrical winch motor is greater than a different, predetermined second layer number current.

2. The constant pulling force winch control system of claim 1, wherein the sensor is a position sensor that measures the distance from the center axis of the winch drum to the outer edge of the layered wound portion of the winch cable wound around the winch drum.

3. The constant pulling force winch control system of claim 2, wherein a moveable tension plate that rests against the layered wound portion of the winch cable is configured to move in an outward or inward radial direction relative to the center axis of the winch drum as the winch cable is wound or unwound, and wherein the position sensor senses a position of the tension plate to measure the distance from the center axis of the winch drum to the outer edge of the layered wound portion of the winch cable wound around the winch drum.

4. The constant pulling force winch control system of claim 3, wherein the tension plate rotates about a tensioner shaft and the position sensor senses an angular position of the tension plate relative to the tensioner shaft to measure the distance from the center axis of the winch drum to the outer edge of the layered wound portion of the winch cable wound around the winch drum, and wherein a spring biases the tension plate against the winch cable.

5. The constant pulling force winch control system of claim 1, wherein when the distance from the center axis of the winch drum to the outer edge of the layered wound portion of the winch cable wound around the winch drum increases, the control system increases the electrical current applied to the electrical winch motor, and when the distance from the center axis of the winch drum to the outer edge of the layered wound portion of the winch cable wound around the winch drum decreases, the control system decreases the electrical current applied to the electrical winch motor.

6. A constant load winch comprising: a rotatable winch drum; a winch cable that can be wound about and unwound from an outer surface of the winch drum, relative to an axis of rotation of the winch drum; an electric winch motor that drives rotation of the winch drum; and a constant load winch control system including a sensor that senses a number of layers of winch cable wound about the winch drum and a control system configured to output a control signal to the electric winch motor to control the electric winch motor to achieve a constant pulling force on the winch cable based on the number of layers sensed by the sensor and turn off the electric winch motor when an electrical current of the electric winch motor is greater than a threshold current for the determined number of layers, where for each different number of layers wound around the winch drum, there is a different threshold current for turning off the electric winch motor.

7. A method of operating a winch system to achieve a constant pulling force comprising the steps of, via a winch control system:

setting a predefined constant pulling force for the winch system;

determining a distance from a center axis of rotation of a winch drum of the winch system to an outer edge of a top layer of a winch cable wound around the winch drum;

applying power to a winch motor of the winch system to rotate the winch drum and achieve the predefined constant pulling force;

monitoring the distance from the center axis of rotation to the top layer of winch cable;

determining whether a change is detected in the distance from the center axis of rotation to the top layer of winch cable;

when the distance from the center axis of rotation to the top layer of winch cable changes, adjusting the power applied to the winch motor to maintain the predefined constant pulling force, wherein: the winch motor is an electrical winch motor; applying power to the winch motor comprises applying electrical current to the electrical winch motor; and adjusting the power to the winch motor comprises adjusting the electrical current applied to the electrical winch motor to achieve the predefined constant pulling force;

when it is determined that the distance from the center axis of rotation to the top layer of winch cable has increased, increasing the electrical current applied to the electrical winch motor so as to maintain the predefined constant pulling force and when it is determined that the distance from the center axis of rotation to the top layer of winch cable has decreased, decreasing the electrical current applied to the electrical winch motor so as to maintain the predefined constant pulling force; and determining a number of layers of winch cable wound around the winch drum based on the determined distance from the center axis of rotation of the winch drum to the outer edge of the top layer of the winch cable and turning off the electrical winch motor in response to the applied electrical current to the electrical winch motor being greater than a threshold current for the determined number of layers, where each different number of layers has a different threshold current for turning off the electrical winch motor.

8. The method of operating a winch system of claim 7, wherein: determining the distance from the center axis of rotation to the top layer of winch cable comprises sensing an angular position of a tension plate pressed against the winch cable relative to a tensioner shaft; and determining whether a change is detected in the distance from the center axis of rotation to the top layer of winch cable comprises sensing a change in the angular position of the tension plate.

9. A non-transitory computer readable medium storing a computer program, wherein when a control system of a winch system executes the computer program the winch system performs the steps of: setting a predefined constant pulling force for the winch system; determining a number of windings of a winch cable wound around a rotatable winch drum of the winch system; applying power to a winch motor of the winch system, via the control system, to rotate the winch drum and achieve the predefined constant pulling force based on the determined number of windings; monitoring the number of windings of the winch cable wound around the winch drum; determining whether a change is detected in the number of windings of the winch cable; and in response to the number of windings of the winch cable changing, adjusting the power applied to the winch motor, via the control system, to maintain the predefined constant pulling force, wherein: the winch motor is an electric winch motor; applying power to the winch motor comprises applying electrical current to the electric winch motor; and adjusting the power to the winch motor comprises adjusting the electrical current applied to the electric winch motor such that when it is determined that the number of windings of the winch cable wound around the winch drum has increased, the electrical current applied to the electric winch motor is increased so as to maintain the predefined constant pulling force, and when it is determined that the number of windings of the winch cable wound around the winch drum has decreased, the electrical current applied to the electric winch motor is decreased so as to maintain the predefined constant pulling force, and wherein: the winch system includes a load limiter and the control system performs the additional steps of:

in response to the determined number of windings being at a threshold layer number, turning off the electric winch motor in response to the electrical current of the electric winch motor being greater than a threshold current for the threshold layer number, where each layer number has a different threshold current for turning off the electric winch motor.

10. A constant load winch comprising: a rotatable winch drum;

a winch cable that can be wound about and unwound from an outer surface of the winch drum, relative to an axis of rotation of the winch drum; a winch motor that drives rotation of the winch drum; a constant load winch control system including a sensor that senses a number of layers of winch cable wound about the winch drum; a control system configured to output a control signal to the winch motor to control the winch motor to achieve a constant pulling force on the winch cable based on the number of layers sensed by the sensor and limit a hydraulic pressure to the winch motor when a hydraulic pressure of the winch motor is greater than a threshold hydraulic pressure for the determined number of layers, where for each different number of layers wound around the winch drum, there is a different threshold hydraulic pressure for limiting the hydraulic pressure to the winch motor; and a plurality of pressure relief valves adapted to open when the winch reaches an associated threshold hydraulic pressure, where for each different number of layers wound around the winch drum, there is a different associated pressure relief valve adapted to open at a different threshold hydraulic pressure for that layer.

* * * * *